US009765784B2

(12) United States Patent
Smerud et al.

(10) Patent No.: US 9,765,784 B2
(45) Date of Patent: Sep. 19, 2017

(54) OLDHAM COUPLING WITH ENHANCED KEY SURFACE IN A SCROLL COMPRESSOR

(71) Applicant: Trane International Inc., Piscataway, NJ (US)

(72) Inventors: Scott Joseph Smerud, La Crosse, WI (US); Brennon J. Swaney, Holmen, WI (US); Jerry Allen Rood, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 444 days.

(21) Appl. No.: 14/448,378

(22) Filed: Jul. 31, 2014

(65) Prior Publication Data

US 2015/0037190 A1 Feb. 5, 2015

Related U.S. Application Data

(60) Provisional application No. 61/860,315, filed on Jul. 31, 2013.

(51) Int. Cl.

| | |
|---|---|
| ***F04C 29/00*** | (2006.01) |
| ***F01C 17/06*** | (2006.01) |
| ***F04C 18/02*** | (2006.01) |
| ***F04C 23/00*** | (2006.01) |
| ***F04C 29/04*** | (2006.01) |

(52) U.S. Cl.

CPC ..... *F04C 29/042* (2013.01); *F01C 17/066* (2013.01); *F04C 18/0215* (2013.01); *F04C 23/001* (2013.01); *F04C 23/008* (2013.01)

(58) Field of Classification Search

CPC .. F04C 17/066; F04C 18/0215; F04C 23/001; F04C 23/008; F04C 29/0042; F04C 23/003; F04C 25/00; F04C 25/02

See application file for complete search history.

(56) References Cited

U.S. PATENT DOCUMENTS

| | | | | |
|---|---|---|---|---|
| 5,080,566 | A | 1/1992 | Sakata et al. | |
| 5,542,829 | A | 8/1996 | Inagaki et al. | |
| 5,593,295 | A | 1/1997 | Hill | |
| 5,616,016 | A | 4/1997 | Hill et al. | |
| 6,106,252 | A | 8/2000 | Yamanaka et al. | |
| 6,190,147 | B1 | 2/2001 | Kimbara et al. | |
| 6,331,102 | B1 | 12/2001 | Takeuchi et al. | |
| 6,666,669 | B2 | 12/2003 | Suss | |
| 6,672,846 | B2 * | 1/2004 | Rajendran | F04C 18/0215 418/55.1 |
| 6,746,223 | B2 | 6/2004 | Manole | |

(Continued)

*Primary Examiner* — Mary A Davis

(74) *Attorney, Agent, or Firm* — Hamre, Schumann, Mueller & Larson, P.C.

(57) ABSTRACT

An Oldham coupling structure for a scroll compressor decreases Oldham coupling pressure loading without increasing compressor diameter or significantly increasing orbiting scroll or Oldham coupling inertia. The Oldham coupling key height and area are increased by recessing the key face into the ring portion of the Oldham coupling, increasing the key height and adding pads to the involute side of the orbiting scroll base plate to extend the key slot, potentially resulting in reduced compressor diameter and/or reduced orbiting scroll and Oldham coupling inertia.

16 Claims, 4 Drawing Sheets

(56) References Cited

U.S. PATENT DOCUMENTS

| | | | | |
|---|---|---|---|---|
| 7,201,567 | B2 * | 4/2007 | Wiertz | F04C 18/0215 418/55.1 |
| 8,353,692 | B2 | 1/2013 | Mori et al. | |
| 8,523,544 | B2 * | 9/2013 | Shaffer | F04C 23/001 418/55.1 |
| 8,814,545 | B2 * | 8/2014 | Li | F04C 18/0215 418/55.1 |
| 2004/0105770 | A1 * | 6/2004 | Sakamoto | F04C 18/0215 418/5 |
| 2010/0119397 | A1 | 5/2010 | Sato et al. | |
| 2010/0209278 | A1 | 8/2010 | Tarao et al. | |
| 2011/0165006 | A1 | 7/2011 | Hirata | |

* cited by examiner

OLDHAM COUPLING WITH ENHANCED KEY SURFACE IN A SCROLL COMPRESSOR

FIELD

The embodiments described herein relate generally to scroll compressors. More particularly, the embodiments described herein relate to an Oldham coupling structure with an enhanced key surface for use in a scroll compressor, such as may be used in a refrigeration or HVAC system.

BACKGROUND

One increasingly popular type of compressor is a scroll compressor. In a scroll compressor, a pair of scroll members orbits relative to each other to compress an entrapped refrigerant.

In typical scroll compressors, a first, stationary, scroll member has a base and a generally spiral wrap extending from its base. A second, orbiting, scroll member has a base and a generally spiral wrap extending from its base. The second, orbiting, scroll member is driven to orbit by a rotating shaft. Some scroll compressors employ an eccentric pin on the rotating shaft that drives the second, orbiting, scroll member.

SUMMARY

In some scroll compressors, a special coupling, known as an Oldham coupling, may be used to allow the second scroll member to orbit relative to the first scroll member when driven by the rotating shaft. As the second scroll member orbits relative to the first, compression chambers defined between the wraps of the first and second scroll member decrease in size to compress the refrigerant.

Some Oldham couplings may demonstrate a fatigue failure in the web structure when one or more guides or keys become worn. Fatigue failure of the Oldham coupling across its web structure is a critical failure mode of the coupling. Quite often wear of one or more guides or keys precedes the failure. Poor lubrication conditions may promote wear and subsequent fatigue failure of the Oldham coupling, particularly during a low speed defrost often associated with a liquid refrigerant flood back. An Oldham coupling with worn keys reorients itself in a position that induces extra loads on the web leading, potentially, to its fracture. However, fracture of the web has been observed even with non-worn keys. Accordingly, the keys' wear was considered a major precursor of the failure in former attempts to resolve the issue of fracture in the web. Some earlier attempts to eliminate failure of the coupling were concentrated on reducing wear of the keys by utilizing wear resistant coatings on the keys and reducing access of a liquid refrigerant to the area of keys/scroll interaction.

In order to ensure acceptable Oldham coupling key life, an upper limit is set on key face pressure loading. When the optimal geometry of the compressor is such that this pressure limit is not held, one way to decrease pressure loading can be to increase key surface area by either increasing the key length, potentially increasing the diameter of the compressor and Oldham coupling and orbiting scroll inertia loads, or increase key height, potentially resulting in a corresponding increase in the orbiting scroll base plate thickness and inertia loads.

In view of the foregoing, there is a need to provide an Oldham coupling structure that decreases Oldham coupling pressure loading without increasing compressor diameter or significantly increasing orbiting scroll or Oldham coupling inertia. According to one embodiment, Oldham coupling key height and area are increased by recessing the key face into the ring portion of the Oldham coupling, increasing the key height and adding pads to the Oldham coupling ring side of the orbiting scroll base plate to extend the key slot, potentially resulting in reduced compressor diameter and/or reduced orbiting scroll and Oldham coupling inertia.

According to another embodiment, at least one stage of a double-ended two-stage scroll compressor comprises an enhanced Oldham coupling with increased key height and area. The key height and area are increased by recessing the key face into the ring portion of the Oldham coupling, increasing the key height and adding pads to the involute side of the orbiting scroll base plate to extend the key slot, potentially resulting in reduced compressor diameter and/or reduced orbiting scroll and Oldham coupling inertia.

DRAWINGS

These and other features, aspects, and advantages of the Oldham coupling structure with an enhanced key surface will become better understood when the following detailed description is read with reference to the accompanying drawing, wherein.

While the above-identified drawing figures set forth particular embodiments of the Oldham coupling structure with an enhanced key surface, other embodiments are also contemplated, as noted in the discussion. In all cases, this disclosure presents illustrated embodiments by way of representation and not limitation. Numerous other modifications and embodiments can be devised by those skilled in the art which fall within the scope and spirit of the principles described herein.

DETAILED DESCRIPTION

Figure 1:
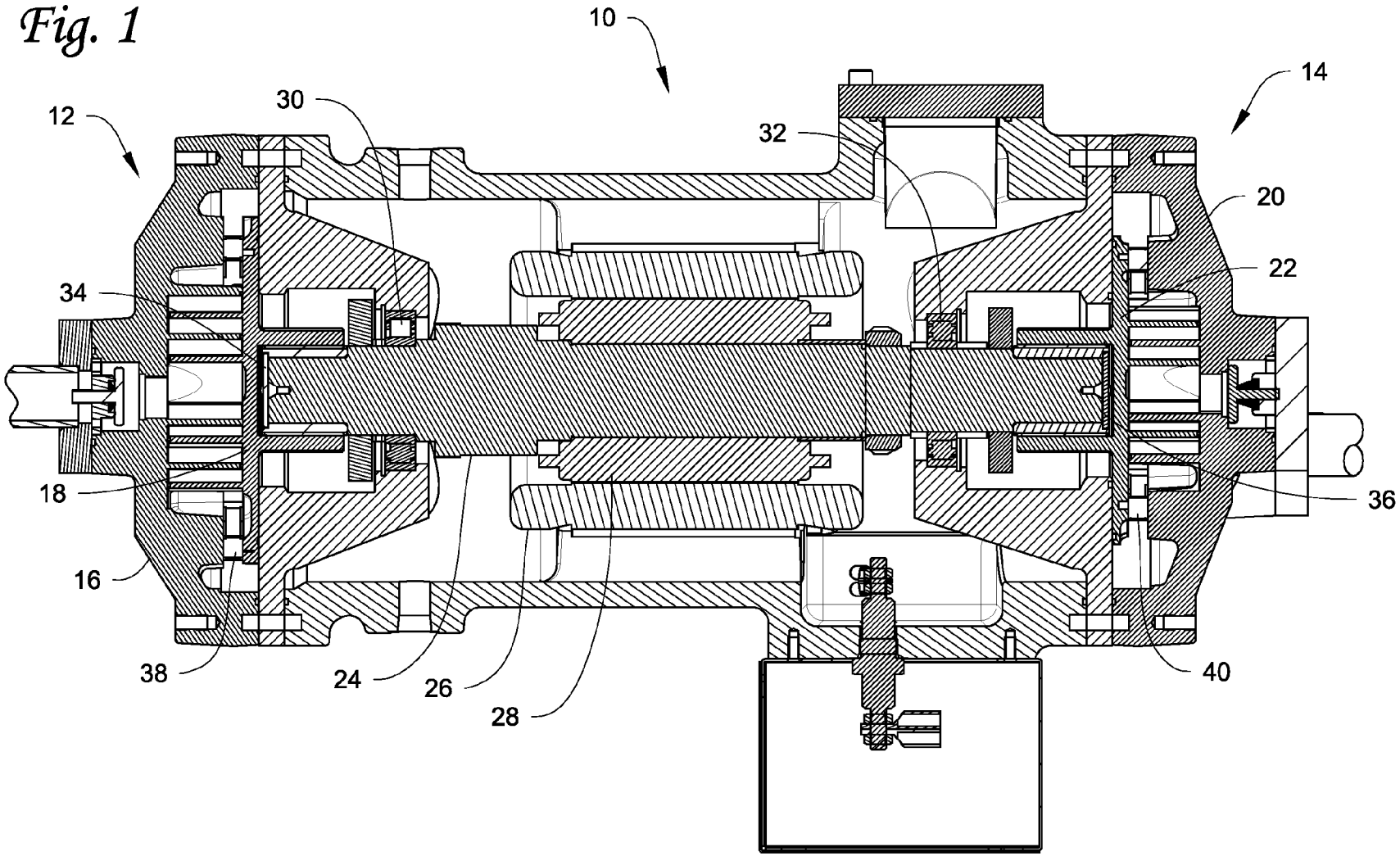
FIG. 1 is a side cross-sectional view of a double-ended two-stage horizontal scroll compressor, according to one embodiment.

FIG. 1 is a side cross-sectional view of a double-ended two-stage horizontal scroll compressor 10, according to one embodiment. Although particular embodiments are described herein with respect to horizontal double-ended two-stage scroll compressors, it will be appreciated the principles described herein are not so limited, and may just as easily be applied to multi-stage scroll compressors having more than two stages as well as single-stage scroll compressors. It will be appreciated that, while horizontal orientation of a scroll compressors are discussed and shown, the Oldham coupling features described herein can apply to and be suitable for vertically oriented scroll compressors.

The two-stage horizontal scroll compressor 10 comprises a first, input stage 12 and a second, output stage 14. The first, input stage 12 comprises a fixed, non-orbiting scroll member 16 and an orbiting scroll member 18. The non-orbiting scroll member 16 is positioned in meshing engagement with the orbiting scroll member 18.

The second, output stage 14 also comprises a fixed, non-orbiting scroll member 20 and an orbiting scroll member 22. The second stage non-orbiting scroll member 20 is positioned in meshing engagement with the second stage orbiting scroll member 22.

Scroll compressor 10 further comprises a compressor drive shaft 24 or crankshaft extending between the first, input stage 12 and the second, output stage 14. The crankshaft 24 may be rotatably driven, by way of example and not limitation, via an electric motor comprising a wound stator 26 and a rotor 28 which may or may not be in an interference-fit on the compressor crankshaft 24. The crankshaft 24 may be rotatably journaled within one or more main bearings 30, 32. Each crankshaft main bearing 30, 32 may comprise, by way of example and not limitation, a rolling element bearing having a generally cylindrical portion.

According to one embodiment, the first stage 12 further comprises a conventional hydrodynamic type orbiting scroll thrust bearing 34; while the second stage of compression 14 further comprises a hydrostatic type orbiting scroll thrust bearing 36. It will be appreciated that at least one stage, either first or second, may comprise a hydrostatic type orbiting scroll thrust bearing based upon the particular application.

It will be appreciated that the specific bearing types described above are examples only and meant to be non-limiting, as other bearing types may be employed in any of the rolling element, radial, and/or thrust bearings mentioned above.

The first, input stage 12 may further comprise an Oldham coupling enumerated as 38 in FIG. 1. In similar fashion, the second, output stage 14 may comprise an Oldham coupling 40. Numerous Oldham coupling structures are well known in the compressor art, and so further details are not discussed herein other than to say that an Oldham coupling allows an orbiting scroll member to orbit relative to a stationary or non-orbiting scroll member when driven by a rotating shaft.

As shown, the Oldham couplings 38, 40 are shown to be between respective first scroll member second scroll member bases at each of the first and second stages, and are in surrounding relationship to the first and second scroll member spiral wraps. However, it will be appreciated that the coupling may be disposed for example on an opposite involute side of the respective orbiting scroll base plate, rather than between the scroll sets.

Figure 2:
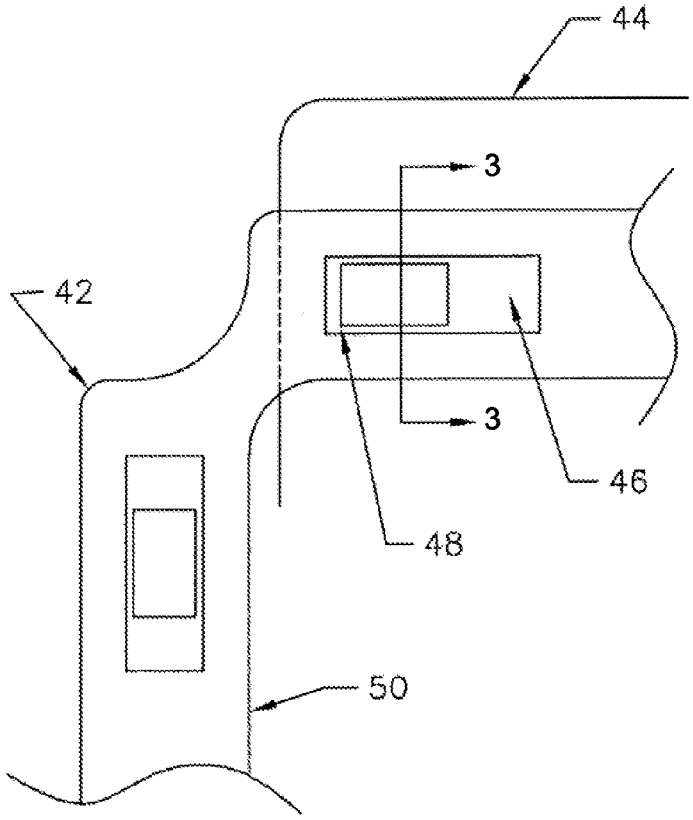
FIG. 2 is a top cross-sectional view portion of an Oldham coupling slot engaging an orbiting scroll key, known in the art.
Figure 3:
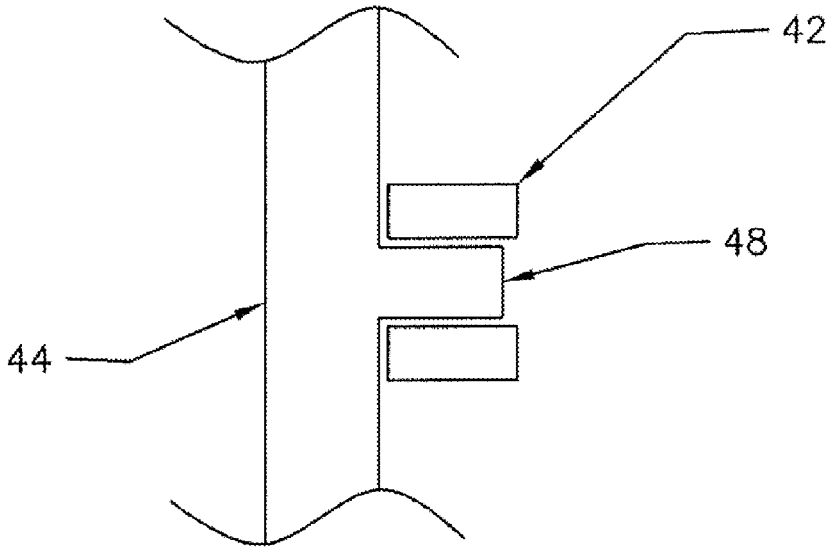
FIG. 3 is a side cross-sectional view portion of the Oldham coupling slot and orbiting scroll key depicted in FIG. 2.

FIG. 2 is a top view portion of an Oldham coupling (OC) 42 engaging an orbiting scroll (OS) 44; while FIG. 3 is a side cross-sectional view portion of the Oldham coupling 42 and orbiting scroll (OS) 44 depicted in FIG. 2. The Oldham coupling 42 comprises a plurality of key slots 46 in the Oldham coupling ring 50. The orbiting scroll 44 comprises a plurality of keys 48. The plurality of key slots 46 are configured to receive the plurality of orbiting scroll keys 48. Generally, an upper limit is set on key face pressure loading in order to ensure acceptable Oldham coupling key life, as stated herein. When the optimal geometry of the compressor is such that this pressure limit is not held, one way to decrease pressure loading is to increase key 48 surface area by either increasing the key length, potentially increasing the diameter of the compressor and Oldham coupling 42 and orbiting scroll inertia loads, or by increasing key height, potentially resulting in a corresponding increase in the orbiting scroll base plate thickness and inertia loads, as also stated herein. "Key height" refers to the vertical dimension of the key 48 in FIG. 3. "Key length" refers to the horizontal direction of the key 48 in FIG. 2. Generally, irrespective of the orientation shown in FIGS. 2 and 3, the key length is in the direction of relative motion of the mating part and the key height is perpendicular to the key length on the loaded surface of the key.

Figure 4:
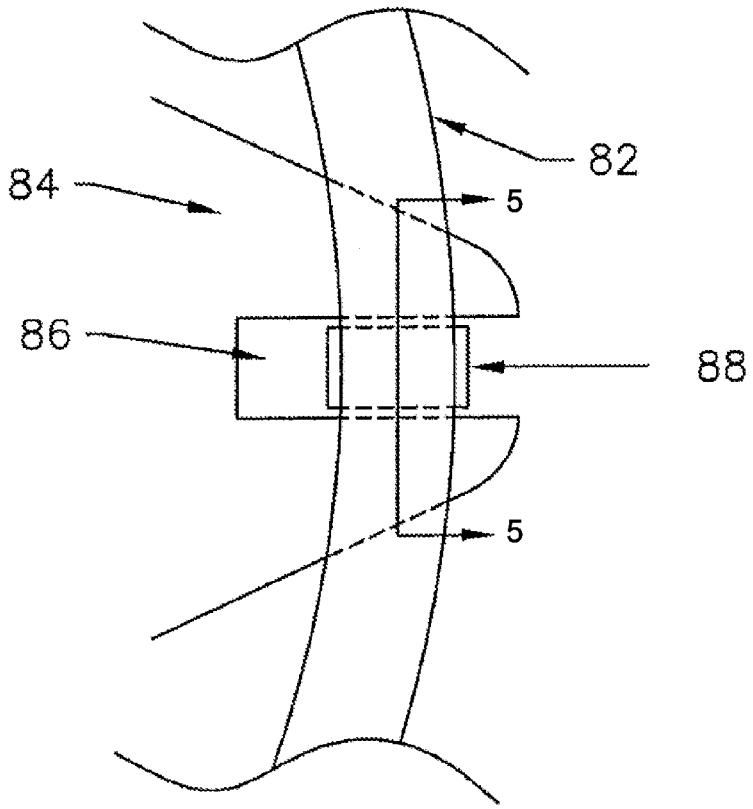
FIG. 4 is a top cross-sectional view portion of an Oldham coupling key engaging an orbiting scroll slot, known in the art.
Figure 5:
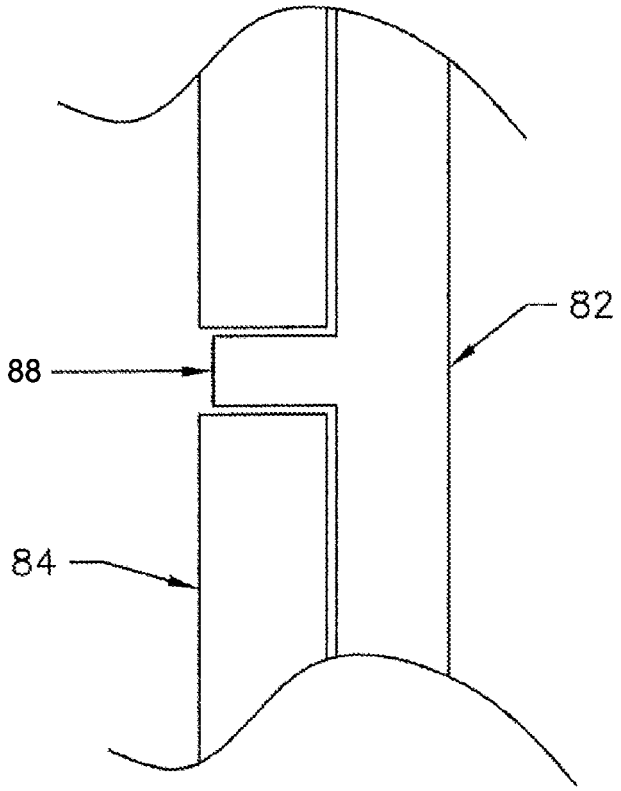
FIG. 5 is a side cross-sectional view portion of the Oldham coupling key and orbiting scroll slot depicted in FIG. 4.

FIG. 4 is a top view portion of an Oldham coupling (OC) 82 engaging an orbiting scroll (OS) 84; while FIG. 5 is a side cross-sectional view portion of the Oldham coupling 82 and orbiting scroll (OS) 84 depicted in FIG. 4. The Oldham coupling 82 comprises a plurality of keys 88 on the Oldham coupling 82. The orbiting scroll 84 comprises a plurality of key slots 86. The plurality of orbiting scroll key slots 86 are configured to receive the plurality of Oldham coupling keys 88. Generally, an upper limit is set on key face pressure loading in order to ensure acceptable Oldham coupling key slot life, as stated herein. When the optimal geometry of the compressor is such that this pressure limit is not held, one way to decrease pressure loading is to increase key 88 surface area by either increasing the key length, potentially increasing the diameter of the compressor and Oldham coupling 82 and orbiting scroll inertia loads, or by increasing key height, potentially resulting in a corresponding increase in the orbiting scroll base plate thickness and inertia loads, as also stated herein. "Key height" refers to the vertical dimension of the key 88 in FIG. 5. "Key length" refers to the horizontal direction of the key 88 in FIG. 4. Generally, irrespective of the orientation shown in FIGS. 4 and 5, the key length is in the direction of relative motion of the mating part and the key height is perpendicular to the key length on the loaded surface of the key.

Figure 6:
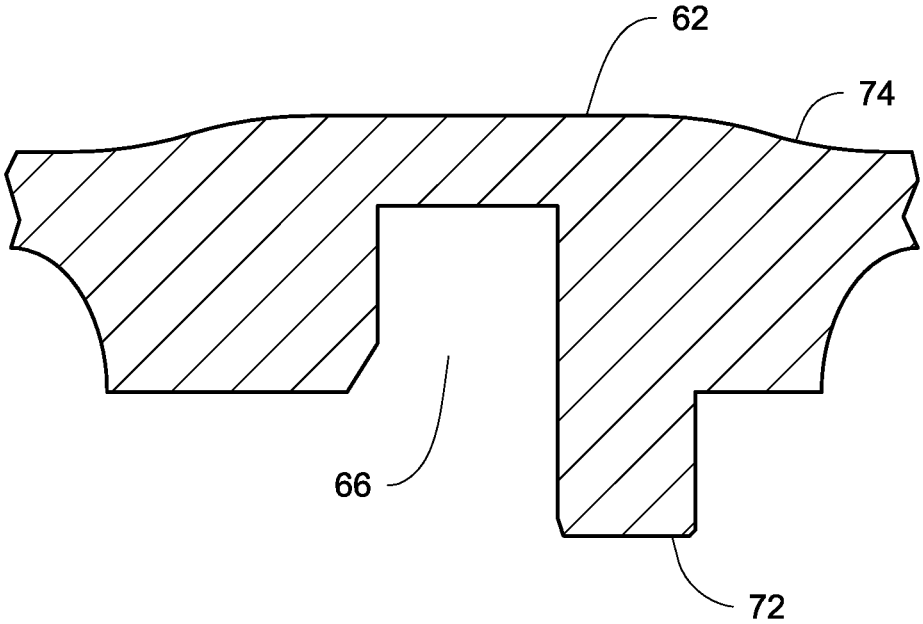
FIG. 6 is a side cross-sectional view portion of an Oldham coupling and orbiting scroll, according to one embodiment.
Figure 6:
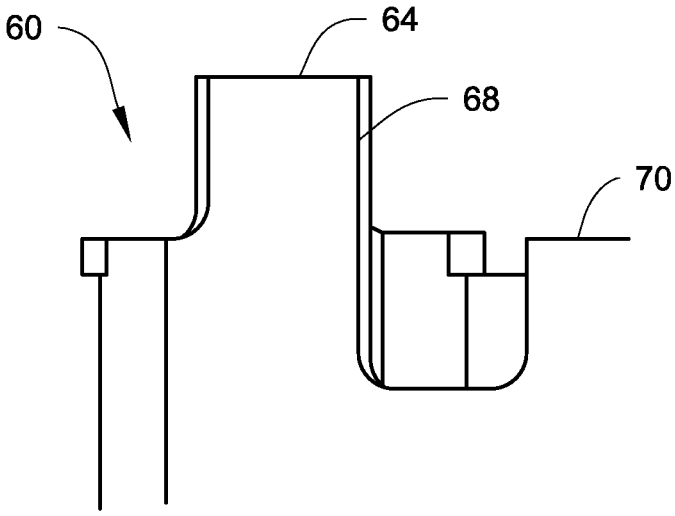

Keeping the foregoing principles in mind, FIG. 6 illustrates a side cross-sectional view portion of an Oldham coupling 60 and orbiting scroll 62, according to one embodiment. The Oldham coupling 60 comprises a key 64. The orbiting scroll 62 comprises a key slot 66 configured to receive the Oldham coupling key 64. It will be appreciated that the Oldham coupling 60 may comprise a plurality of keys 64 in which the number and placement of keys 64 are dependent upon the particular application. In similar fashion, the orbiting scroll 62 may comprise a plurality of key slots 66 in which the number and placement of key slots 66 are dependent upon the particular application. The present inventors recognized that Oldham coupling face pressure loading can be maintained, and Oldham coupling bending moment and orbiting scroll and Oldham coupling mass minimized by recessing the loaded key face 68 into the Oldham coupling ring 70 and/or adding a raised portion 72 to the orbiting scroll key slot 66. The function of the raised portion 72 (e.g. key-like surface) of the orbiting scroll is to allow for a relatively thinner orbiting scroll base plate for a given Oldham coupling key height. The key-like surface on the orbiting scroll extends the key face without having to machine deeper into the orbiting scroll base plate, e.g. at the key slot 66. The loaded key slot (66) face and the loaded face of the orbiting key like surface (72) in some embodiments are coplanar. It will be appreciated that the relative dimensions of the height of the key like surface(s) 72 and depth of key slot(s) 66 on the orbiting scroll may vary as needed and/or desired. For example, a ratio of the added key type surface height to the overall key height can be in the range of about 0.2:1 to about 0.6:1.

According to one embodiment, at least one stage of a double-ended two-stage scroll compressor 10 comprises enhanced Oldham couplings/Oldham coupling keys in which the Oldham couplings/Oldham coupling keys and its associated orbiting scroll are configured as described herein with reference to FIG. 6. The enhanced Oldham coupling/Oldham coupling key structure in association with a respective orbiting scroll can advantageously decrease Oldham coupling pressure loading by increasing key area without increasing the associated compressor diameter or significantly increasing the orbiting scroll or Oldham coupling inertia, as stated herein.

Looking again at FIG. 6, the key height and area are increased by recessing the loaded key face 68 into the ring portion 70 of the Oldham coupling 60, increasing the overall key height and adding pads or raised portion 72 to the orbiting scroll base plate 74, such as on the involute side, to extend the key slot 66, potentially resulting in reduced compressor diameter and/or reduced orbiting scroll and Oldham coupling inertia, as stated herein.

In summary explanation, an Oldham coupling in a scroll compressor is configured with an enhanced key surface. The loaded side of the key is recessed into the Oldham coupling ring and a raised key slot is added to the orbiting scroll to maintain Oldham coupling key surface pressure and minimize key bending torque and orbiting scroll weight.

Any of aspects 1 to 8 can be combined with any of aspects 9 to 24 and any of aspects 9 to 16 can be combined with any of 17 to 24.

Aspect 1. An Oldham coupling structure for a scroll compressor, the Oldham coupling structure comprising: a compressor housing; a first stage of compression disposed within the compressor housing, the first stage comprising: a first, stationary, scroll member comprising a base and a generally spiral wrap extending from the base of the first, stationary, scroll member; and a second, orbiting, scroll member comprising a substantially circular base and a generally spiral wrap extending from the base of the second, orbiting scroll member; and a first Oldham coupling disposed on the second scroll member base, wherein the first Oldham coupling comprises a ring member comprising one or more coupling keys, and further wherein each first Oldham coupling key comprises a loaded side face that is recessed into the ring member of the first Oldham coupling to form a recessed portion of the first Oldham coupling ring member.

Aspect 2. The scroll compressor Oldham coupling structure according to aspect 1, wherein the second, orbiting, scroll member further comprises a protruding portion extending toward the first Oldham coupling and configured to mesh with the recessed portion of the first Oldham coupling ring member.

Aspect 3. The scroll compressor Oldham coupling structure according to aspect 1 or 2, further comprising: a second stage of compression disposed within the compressor housing, the second stage comprising: a third, stationary, scroll member comprising a base and a generally spiral wrap extending from the base of the third, stationary, scroll member; and a fourth, orbiting, scroll member comprising a substantially circular base and a generally spiral wrap extending from the base of the fourth, orbiting scroll member; and a second Oldham coupling disposed on the third scroll member base, wherein the second Oldham coupling comprises a ring member comprising one or more coupling keys, and further wherein each second Oldham coupling key comprises a loaded side face that is recessed into the ring member of the second Oldham coupling to form a recessed portion of the second Oldham coupling ring member.

Aspect 4. The scroll compressor Oldham coupling structure according to aspect 3, wherein the fourth, orbiting, scroll member further comprises a protruding portion extending toward the second Oldham coupling and configured to mesh with the recessed portion of the second Oldham coupling ring member.

Aspect 5. The scroll compressor Oldham coupling structure according to any of aspects 1 to 4, wherein the scroll compressor is a single-stage scroll compressor.

Aspect 6. The scroll compressor Oldham coupling structure according to any of aspects 1 to 5, wherein the scroll compressor is a double-ended two-stage scroll compressor.

Aspect 7. The scroll compressor Oldham coupling structure according to any of aspects 1 to 6, wherein the scroll compressor comprises more than two sets of single stage compression.

Aspect 8. The scroll compressor Oldham coupling structure according to any of aspects 1 to 7, wherein the scroll compressor is a horizontal scroll compressor.

Aspect 9. An Oldham coupling structure for a scroll compressor, the Oldham coupling structure comprising: a first Oldham coupling disposed on a first, stationary, scroll member base comprising a generally spiral wrap extending therefrom, a second, orbiting, scroll member base comprising a generally spiral wrap extending therefrom, wherein the first Oldham coupling comprises a ring member comprising one or more coupling keys, and further wherein each first Oldham coupling key comprises a loaded side face that is recessed into the ring member of the first Oldham coupling to form a recessed portion of the first Oldham coupling ring member.

Aspect 10. The scroll compressor Oldham coupling structure according to aspect 9, wherein the second, orbiting, scroll member further comprises a protruding portion extending toward the first Oldham coupling and configured to mesh with the recessed portion of the first Oldham coupling ring member.

Aspect 11. The scroll compressor Oldham coupling structure according to aspect 9 or 10, further comprising: a second Oldham coupling disposed on a third, stationary, scroll member base comprising a generally spiral wrap extending therefrom, a fourth, orbiting, scroll member base comprising a generally spiral wrap extending therefrom, wherein the second Oldham coupling comprises a ring member comprising one or more coupling keys, and further wherein each second Oldham coupling key comprises a loaded side face that is recessed into the ring member of the second Oldham coupling to form a recessed portion of the second Oldham coupling ring member.

Aspect 12. The scroll compressor Oldham coupling structure according to aspect 11, wherein the fourth, orbiting, scroll member further comprises a protruding portion extending toward the second Oldham coupling and configured to mesh with the recessed portion of the second Oldham coupling ring member.

Aspect 13. The scroll compressor Oldham coupling structure according to any of aspects 9 to 12, wherein the scroll compressor is a single-stage scroll compressor.

Aspect 14. The scroll compressor Oldham coupling structure according to any of aspects 9 to 13, wherein the scroll compressor is a double-ended two-stage scroll compressor.

Aspect 15. The scroll compressor Oldham coupling structure according to any of aspects 9 to 14, wherein the scroll compressor comprises more than two sets of single stage compression.

Aspect 16. The scroll compressor Oldham coupling structure according to any of aspects 9 to 15, wherein the scroll compressor is a horizontal scroll compressor.

Aspect 17. An Oldham coupling structure for a scroll compressor, the Oldham coupling structure comprising a first Oldham coupling comprising a ring member comprising one or more coupling keys, wherein each first Oldham coupling key comprises a loaded side face that is recessed into the ring member of the first Oldham coupling to form a recessed portion of the first Oldham coupling ring member.

Aspect 18. The scroll compressor Oldham coupling structure according to aspect 17, further comprising a first, orbiting, scroll member, the first, orbiting, scroll member comprising a protruding portion extending toward the first Oldham coupling and configured to mesh with the recessed portion of the first Oldham coupling ring member.

Aspect 19. The scroll compressor Oldham coupling structure according to aspect 17 or 18, further comprising a second Oldham coupling comprising a ring member comprising one or more coupling keys, wherein each second Oldham coupling key comprises a loaded side face that is recessed into the ring member of the second Oldham coupling to form a recessed portion of the second Oldham coupling ring member.

Aspect 20. The scroll compressor Oldham coupling structure according to aspect 19, further comprising a second, orbiting, scroll member comprising a protruding portion extending toward the second Oldham coupling and configured to mesh with the recessed portion of the second Oldham coupling ring member.

Aspect 21. The scroll compressor Oldham coupling structure according to any of aspects 17 to 20, wherein the scroll compressor is a single-stage scroll compressor.

Aspect 22. The scroll compressor Oldham coupling structure according to any of aspects 17 to 21, wherein the scroll compressor is a double-ended two-stage scroll compressor.

Aspect 23. The scroll compressor Oldham coupling structure according to any of aspects 17 to 22, wherein the scroll compressor comprises more than two sets of single stage compression.

Aspect 24. The scroll compressor Oldham coupling structure according to any of aspects 17 to 23, wherein the scroll compressor is a horizontal scroll compressor.

While the embodiments have been described in terms of various specific embodiments, those skilled in the art will recognize that the embodiments can be practiced with modification within the spirit and scope of the claims.

What is claimed is:

1. A scroll compressor, comprising:

a compressor housing;

a first stage of compression disposed within the compressor housing, the first stage comprising:

a first, stationary, scroll member comprising a base and a substantially spiral wrap extending from the base of the first, stationary, scroll member; and a second, orbiting, scroll member comprising a substantially circular base and a substantially spiral wrap extending from the base of the second, orbiting scroll member; and a first Oldham coupling disposed on the second scroll member base, wherein the first Oldham coupling comprises a ring member comprising one or more coupling keys, and further wherein each first Oldham coupling key comprises a loaded side face that is recessed into the ring member of the first Oldham coupling to form a recessed portion of the first Oldham coupling ring member, the recessed portion extending along the loaded side face, wherein the second, orbiting, scroll member further comprises a protruding portion extending toward the first Oldham coupling and configured to mesh with the recessed portion of the first Oldham coupling ring member.

2. The scroll compressor according to claim 1, further comprising:

a second stage of compression disposed within the compressor housing, the second stage comprising:

a third, stationary, scroll member comprising a base and a substantially spiral wrap extending from the base of the third, stationary, scroll member; and a fourth, orbiting, scroll member comprising a substantially circular base and a substantially spiral wrap extending from the base of the fourth, orbiting scroll member; and a second Oldham coupling disposed on the third scroll member base, wherein the second Oldham coupling comprises a ring member comprising one or more coupling keys, and further wherein each second Oldham coupling key comprises a loaded side face that is recessed into the ring member of the second Oldham coupling to form a recessed portion of the second Oldham coupling ring member, the loaded side face of the second Oldham coupling key being oriented facing toward a center of the ring member of the second Oldham coupling, and the recessed portion of the second Oldham coupling member extending along the loaded side face.

3. The scroll compressor according to claim 2, wherein the fourth, orbiting, scroll member further comprises a protruding portion extending toward the second Oldham coupling and configured to mesh with the recessed portion of the second Oldham coupling ring member.

4. The scroll compressor according to claim 1, wherein the scroll compressor is a double-ended two-stage scroll compressor.

5. The scroll compressor according to claim 1, wherein the scroll compressor comprises at least two single stages of compression.

6. The scroll compressor according to claim 1, wherein the scroll compressor is a horizontal scroll compressor.

7. An Oldham coupling structure for a scroll compressor, the Oldham coupling structure comprising:

a first Oldham coupling disposed on a first, stationary, scroll member base comprising a substantially spiral wrap extending therefrom, a second, orbiting, scroll member base comprising a substantially spiral wrap extending therefrom, wherein the first Oldham coupling comprises a ring member comprising one or more coupling keys, and further wherein each first Oldham coupling key comprises a loaded side face that is recessed into the ring member of the first Oldham coupling to form a recessed portion of the first Oldham coupling ring member, the recessed portion extending along the loaded side face, wherein the second, orbiting, scroll member further comprises a protruding portion extending toward the first Oldham coupling and configured to mesh with the recessed portion of the first Oldham coupling ring member.

8. The Oldham coupling structure according to claim 7, further comprising:

a second Oldham coupling disposed on a third, stationary, scroll member base comprising a substantially spiral wrap extending therefrom, a fourth, orbiting, scroll member base comprising a substantially spiral wrap extending therefrom, wherein the second Oldham coupling comprises a ring member comprising one or more coupling keys, and further wherein each second Oldham coupling key comprises a loaded side face that is recessed into the ring member of the second Oldham coupling to form a recessed portion of the second Oldham coupling ring member, the recessed portion of the second Oldham coupling member extending along the loaded side face.

9. The Oldham coupling structure according to claim 8, wherein the fourth, orbiting, scroll member further comprises a protruding portion extending toward the second Oldham coupling and configured to mesh with the recessed portion of the second Oldham coupling ring member.

10. The Oldham coupling structure according to claim 7, wherein the scroll compressor is one of a double-ended two-stage scroll compressor, and a scroll compressor that comprises at least two single stages of compression.

11. The Oldham coupling structure according to claim 7, wherein the scroll compressor is a horizontal scroll compressor.

12. An Oldham coupling structure for a scroll compressor, the Oldham coupling structure comprising:

a first Oldham coupling comprising a ring member comprising one or more coupling keys, wherein each first Oldham coupling key comprises a loaded side face that is recessed into the ring member of the first Oldham coupling to form a recessed portion of the first Oldham coupling ring member, the recessed portion of the first Oldham coupling member extending along the loaded side face, and a first, orbiting, scroll member, the first, orbiting, scroll member comprising a protruding portion extending toward the first Oldham coupling and configured to mesh with the recessed portion of the first Oldham coupling ring member.

13. The Oldham coupling structure according to claim 12, further comprising a second Oldham coupling comprising a ring member comprising one or more coupling keys, wherein each second Oldham coupling key comprises a loaded side face that is recessed into the ring member of the second Oldham coupling to form a recessed portion of the second Oldham coupling ring member, the recessed portion of the second Oldham coupling member extending along the loaded side face.

14. The Oldham coupling structure according to claim 13, further comprising a second, orbiting, scroll member comprising a protruding portion extending toward the second Oldham coupling and configured to mesh with the recessed portion of the second Oldham coupling ring member.

15. The Oldham coupling structure according to claim 12, wherein the scroll compressor is a double-ended two-stage scroll compressor, and a scroll compressor that comprises at least two single stages compression.

16. The Oldham coupling structure according to claim 12, wherein the scroll compressor is a horizontal scroll compressor.

* * * * *